US010209665B2

(12) United States Patent
Komatsu et al.

(10) Patent No.: US 10,209,665 B2
(45) Date of Patent: Feb. 19, 2019

(54) CLEANING DEVICE AND IMAGE FORMING APPARATUS

(71) Applicant: CANON KABUSHIKI KAISHA, Tokyo (JP)

(72) Inventors: Isao Komatsu, Kashiwa (JP); Kunihiko Kitayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/881,964

(22) Filed: Jan. 29, 2018

(65) Prior Publication Data

US 2018/0224797 A1 Aug. 9, 2018

(30) Foreign Application Priority Data

Jan. 30, 2017 (JP) ..... 2017-014510

(51) Int. Cl.

| | |
|---|---|
| ***G03G 21/00*** | (2006.01) |
| ***G03G 15/16*** | (2006.01) |
| ***G03G 15/095*** | (2006.01) |
| ***G03G 15/02*** | (2006.01) |
| ***G03G 21/10*** | (2006.01) |

(52) U.S. Cl.

CPC ..... *G03G 21/0011* (2013.01); *G03G 15/0216* (2013.01); *G03G 15/095* (2013.01); *G03G 15/161* (2013.01); *G03G 21/10* (2013.01); *G03G 2215/025* (2013.01); *G03G 2215/1652* (2013.01); *G03G 2215/1657* (2013.01); *G03G 2215/1661* (2013.01); *G03G 2221/0015* (2013.01)

(58) Field of Classification Search

CPC ..... G03G 21/0011; G03G 15/161; G03G 2215/1652; G03G 2215/1657; G03G 2215/1661; G03G 2221/0015

See application file for complete search history.

(56) References Cited

U.S. PATENT DOCUMENTS

| | | | |
|---|---|---|---|
| 7,142,799 | B2 | 11/2006 | Kitayama |
| 8,180,256 | B2 | 5/2012 | Komatsu |

(Continued)

FOREIGN PATENT DOCUMENTS

| | | | |
|---|---|---|---|
| JP | 2001-183951 | A | 7/2001 |
| JP | 2004-177569 | A | 6/2004 |

(Continued)

*Primary Examiner* — Sandra Brase

(74) *Attorney, Agent, or Firm* — Venable LLP

(57) ABSTRACT

A cleaning device includes a blade and a seal member including a first portion having first, second and third surfaces and including a second portion having a fourth surface. The first surface opposes a free end surface of the blade. The second surface is connected with the first surface. The third surface is connected with the first and second surfaces and is perpendicular to the free end surface. The fourth surface is parallel to the third surface and the free end surface. A first interior corner line is formed by the free end surface and the third surface so as to be substantially parallel to a thickness direction of the blade. A second interior corner line is formed by the third surface and the fourth surface so as to be connected with said first interior corner line and be substantially parallel to a height direction of the blade.

13 Claims, 8 Drawing Sheets

(56) References Cited

U.S. PATENT DOCUMENTS

| | | | | |
|---|---|---|---|---|
| 2009/0185818 | A1* | 7/2009 | Saka | G03G 15/11 399/101 |
| 2009/0208240 | A1* | 8/2009 | Saka | G03G 15/161 399/101 |
| 2010/0028045 | A1* | 2/2010 | Kawakami | G03G 21/0011 399/123 |
| 2010/0098470 | A1* | 4/2010 | Chiba | G03G 15/11 399/351 |
| 2013/0236208 | A1 | 9/2013 | Komatsu | |

FOREIGN PATENT DOCUMENTS

| | | | |
|---|---|---|---|
| JP | 2006-085159 | A | 3/2006 |
| JP | 2006-208849 | A | 8/2006 |
| JP | 2008-134580 | A | 6/2008 |
| JP | 2008-134850 | A | 6/2008 |

* cited by examiner (a)
COMPARATIVE EXAMPLE (b)
COMPARATIVE EXAMPLE (a)
COMPARATIVE EXAMPLE (b)
COMPARATIVE EXAMPLE (a)

COMPARATIVE EXAMPLE (b)

(a)
COMPARATIVE EXAMPLE (b)

CLEANING DEVICE AND IMAGE FORMING APPARATUS

FIELD OF THE INVENTION AND RELATED ART

The present invention relates to a cleaning device used in an image forming apparatus, such as a copying machine, a facsimile machine or a printer, for forming an image with a liquid developer, and relates to the image forming apparatus.

Conventionally, as the image forming apparatus of an electrophotographic type, there is a wet-type image forming apparatus for forming the image by developing an electrostatic latent image, formed on an image bearing member such as a photosensitive drum, with the liquid developer containing toner and a carrier. In such an image forming apparatus, a cleaning blade (hereinafter, simply referred also to as a blade), which is a plate-like member formed of an elastic material, is contacted to a surface of the image bearing member, and the liquid developer is scraped off and removed from the surface of the image bearing member. The blade is, in general, contacted to the surface of the image bearing member so as to face a counter direction to a surface movement direction of the image bearing member, i.e., so that a free end portion thereof faces an upstream side of the surface movement direction of the image bearing member.

The liquid developer scraped off from the surface of the image bearing member extends in a longitudinal direction of the blade by a capillary phenomenon in a small gap between the image bearing member and the blade, and moves toward both end portions of the blade with respect to the longitudinal direction. Then, the liquid developer moved to each of the both end portions of the blade with respect to the longitudinal direction further moves to an outside of the blade, so that the liquid developer generates a "liquid ring" such that the liquid developer is deposited in a ring shape on the surface of the image bearing member with respect to a circumferential direction of the image bearing member. When the liquid ring is generated, a developing device, a charging device, an exposure device and the like which are actable on the image bearing member are caused to be contaminated with the liquid developer, so that the liquid ring leads to a lowering in image quality in some cases.

Therefore, conventionally, Japanese Laid-Open Patent Application (JP-A) 2006-85159 and JP-A 2006-208849 disclose a constitution in which a seal member is provided adjacent to both end surfaces of a blade with respect to a longitudinal direction of the blade.

However, in the conventional constitution in which the seal member is provided adjacent to the end surfaces of the blade with respect to the longitudinal direction, in some cases, leakage of the liquid developer generates due to the capillary phenomenon at an adjacent portion between the longitudinal end surface of the blade and the seal member, and thus the above-described liquid ring generates. Further, in such a constitution, in the case where a sponge is used as the seal member, after the seal member is wetted with the liquid developer, "re-application" such that the liquid developer is steadily applied continuously onto the surface of the image bearing member generates in some cases.

SUMMARY OF THE INVENTION

According to an aspect of the present invention, there is provided a cleaning device, capable of being provided at a predetermined position adjacent to an image bearing member carrying a liquid developer, for cleaning a surface of the image bearing member, the cleaning device comprising: a blade configured to scrape the liquid developer off the surface of the image bearing member with movement of the image bearing member when the cleaning device is in the predetermined position, wherein the blade has a free end on one side and is supported on the other side by a supporting portion, and when the cleaning device is in the predetermined position, the blade satisfies the following i) to iv): i) a front surface which is one of widthwise height surfaces opposes the image bearing member, ii) an edge portion, formed at a crossing portion of the front surface and a free end surface which is a widthwise thickness surface on a free end side, contacts the image bearing member at a contact portion, iii) the free end surface faces an upstream side of a movement direction of the image bearing member at the contact portion, and iv) the supporting portion is positioned above the free end surface with respect to a vertical direction, an accommodating portion configured to accommodate the liquid developer scraped off by the blade; and a pair of seal members provided adjacent to the free end surface in a position which is spaced from each of end portions of the edge portion toward a central portion of the edge portion and which corresponds to a neighborhood of each of the end portions, wherein the seal member positioned on one end side of the image portion with respect to a widthwise direction of the blade includes a first portion and a second portion adjacent to the first portion on the one end side, the first portion including a first surface, a second surface and a third surface, and the second portion including a fourth surface, wherein the first surface is provided opposed to and adjacent to the free end surface when the cleaning device is in the predetermined position, wherein the second surface is connected with the first surface in a neighborhood of the edge portion and is provided opposed to and adjacent to the surface of the image bearing member when the cleaning device is in the predetermined position, wherein the third surface is connected with the first surface and the second surface on the one end side and is provided so as to be substantially perpendicular to the free end surface and front surface and so as to face the one end side, wherein the fourth surface crosses substantially perpendicularly to the third surface and to the free end surface at a position adjacent to the third surface in the one end side and is opposed to the surface of the image bearing member in a position spaced more from the surface of the image bearing member than the second surface is when the cleaning device is in the predetermined position, wherein a first interior corner line is formed by the free end surface and the third surface so as to be substantially parallel to a thickness direction of the blade, and wherein a second interior corner line is formed by the third surface and the fourth surface so as to be connected with the first interior corner line and be substantially parallel to a height direction of the blade.

According to another aspect of the present invention, there is provided an image forming apparatus comprising: a movable image bearing member for carrying a liquid developer; a blade configured to scrape the liquid developer off the surface of the image bearing member with movement of the image bearing member, wherein the blade has a free end on one side and is supported on the other side by a supporting portion, and the blade satisfies the following i) to iv): i) a front surface which is one of widthwise height surfaces opposes the image bearing member, ii) an edge portion, formed at a crossing portion of the front surface and a free end surface which is a widthwise thickness surface on a free end side, contacts the image bearing member at a contact portion, iii) the free end surface faces an upstream side of a movement direction of the image bearing member at the contact portion, and iv) the supporting portion is positioned above the free end surface with respect to a vertical direction, an accommodating portion configured to accommodate the liquid developer scraped off by the blade; and a pair of seal members provided adjacent to the free end surface in a position which is spaced from each of end portions of the edge portion toward a central portion of the edge portion and which corresponds to a neighborhood of each of the end portions, wherein the seal member positioned on one end side of the image portion with respect to a widthwise direction of the blade includes a first portion and a second portion adjacent to the first portion on the one end side, the first portion including a first surface, a second surface and a third surface, and the second portion including a fourth surface, wherein the first surface is provided opposed to and adjacent to the free end surface, wherein the second surface is connected with the first surface in a neighborhood of the edge portion and is provided opposed to and adjacent to the surface of the image bearing member, wherein the third surface is connected with the first surface and the second surface on the one end side and is provided so as to be substantially perpendicular to the free end surface and front surface and so as to face the one end side, wherein the fourth surface crosses substantially perpendicularly to the third surface and to the free end surface at a position adjacent to the third surface in the one end side and is opposed to the surface of the image bearing member in a position spaced more from the surface of the image bearing member than the second surface is, wherein a first interior corner line is formed by the free end surface and the third surface so as to be substantially parallel to a thickness direction of the blade, and wherein a second interior corner line is formed by the third surface and the fourth surface so as to be connected with the first interior corner line and be substantially parallel to a height direction of the blade.

Further features of the present invention will become apparent from the following description of exemplary embodiments with reference to the attached drawings.

Figure 2:
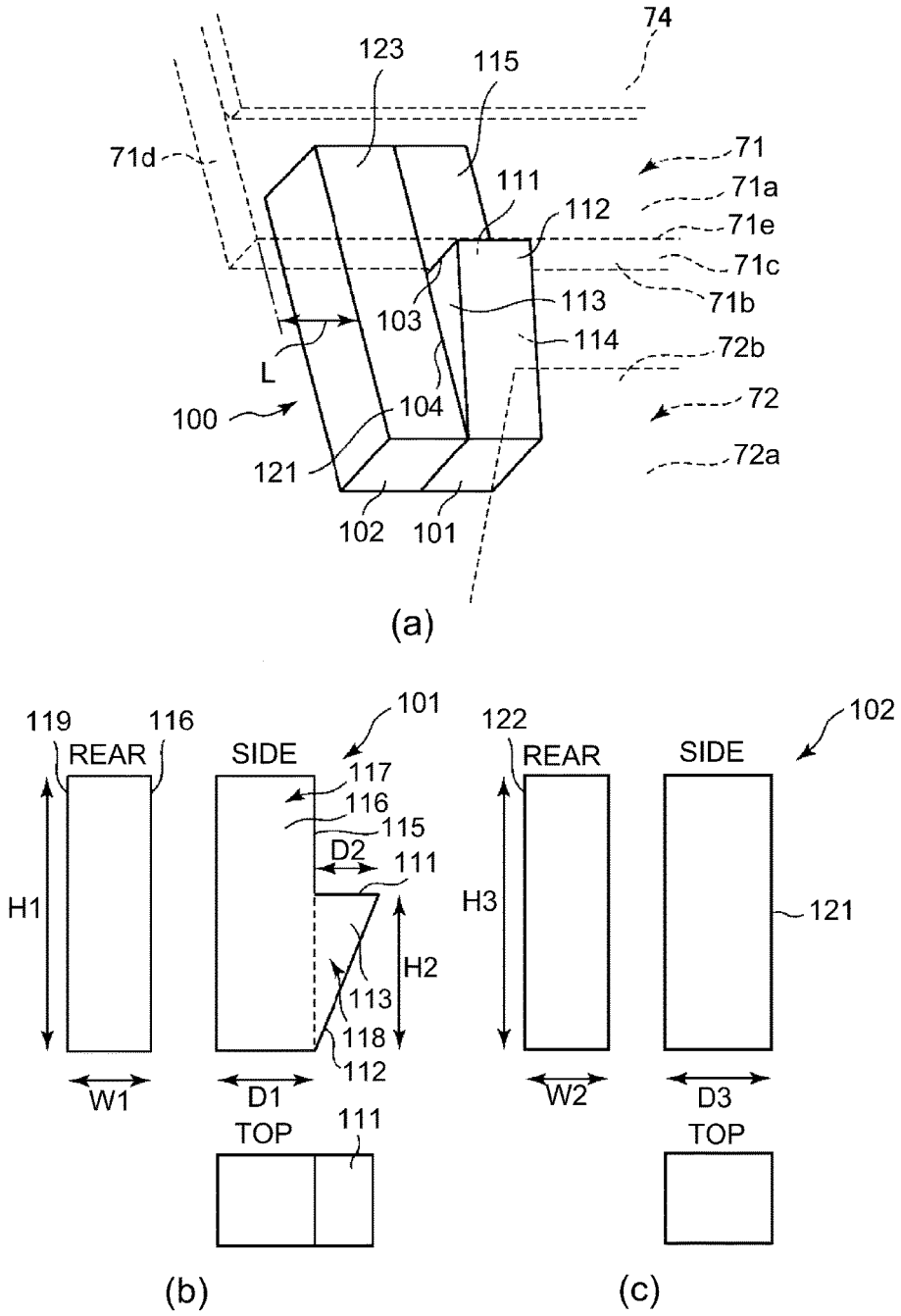

Parts (a), (b) and (c) of FIG. 2 are a perspective view, rear and side views, and a top (plan) view, respectively, of a seal member.

Figure 3:
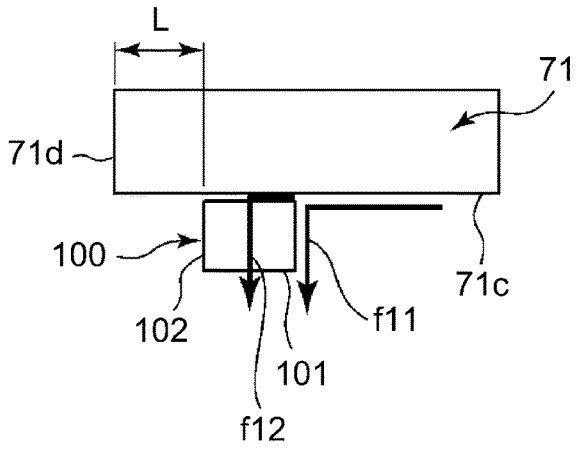

FIG. 3 is a schematic view showing a flow of a liquid developer in Embodiment 1.

Figure 4:
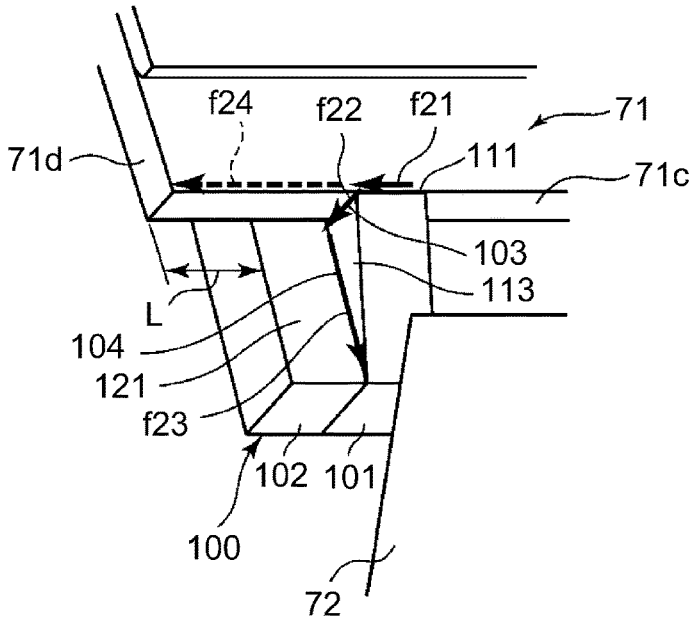

FIG. 4 is a perspective view showing a flow of the liquid developer in Embodiment 1.

Figure 5:
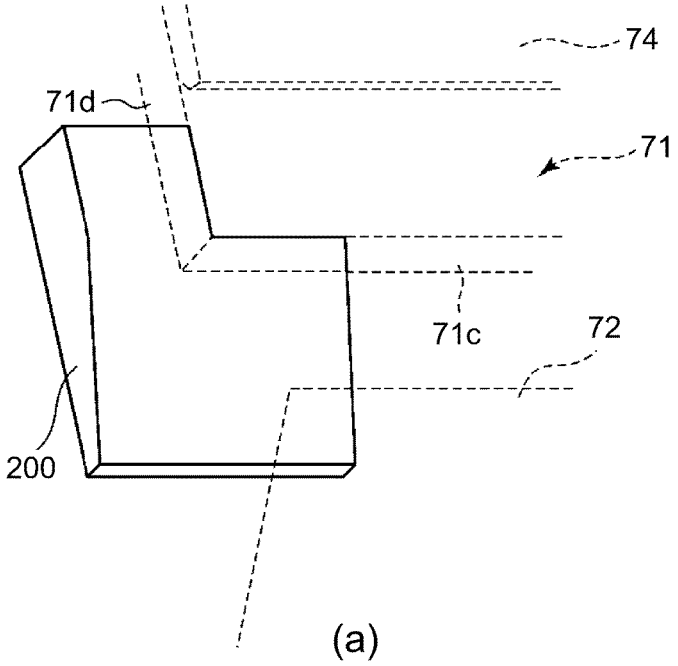
Figure 5:
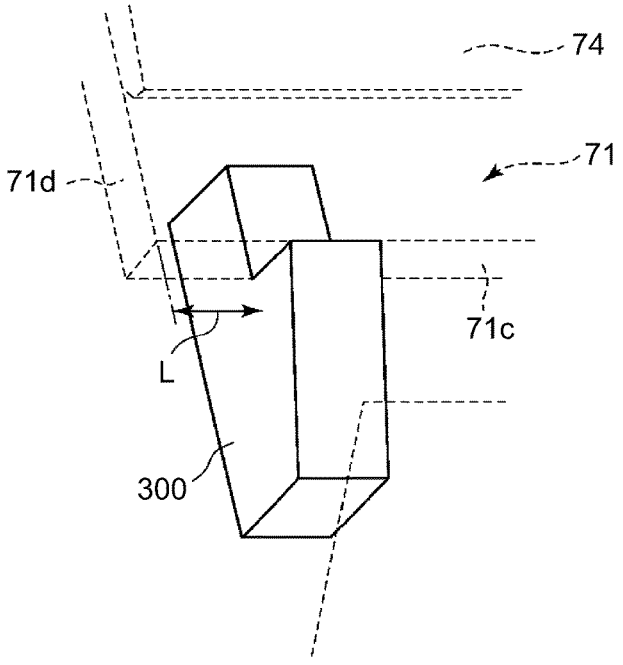

Parts (a) and (b) of FIG. 5 are perspective views of a seal member in Comparison Example.

Figure 6:
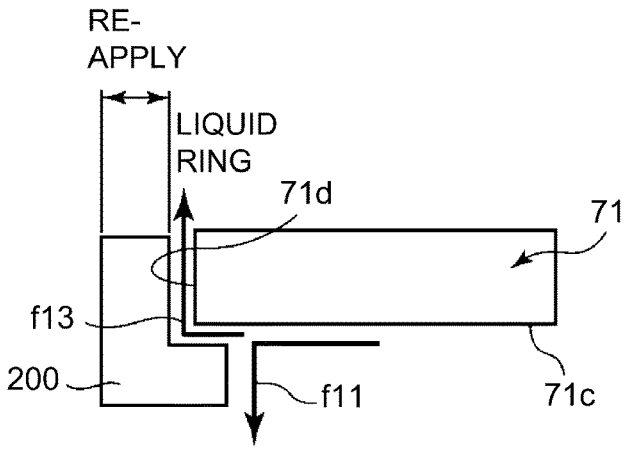
Figure 6:
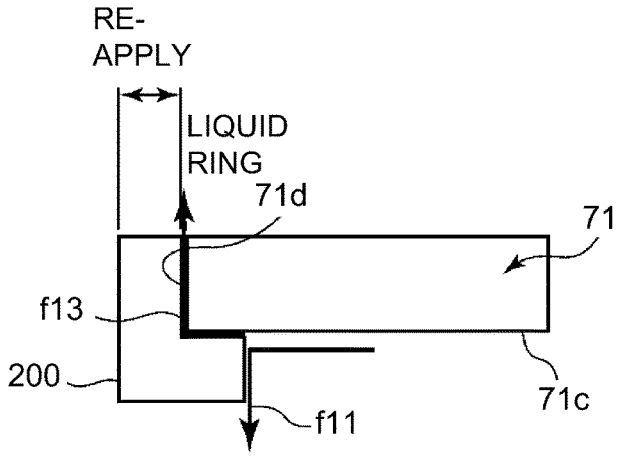

Parts (a) and (b) of FIG. 6 are schematic views showing a flow of a liquid developer in Comparison Example.

Figure 7:
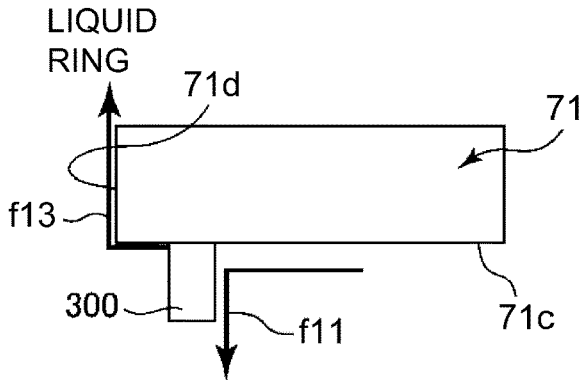
Figure 7:
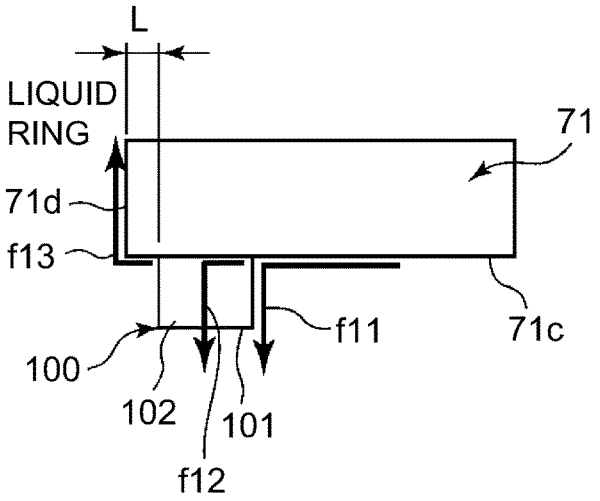

Parts (a) and (b) of FIG. 7 are schematic views showing the flow of the liquid developer in Comparison Example and Embodiment 2, respectively.

Figure 8:
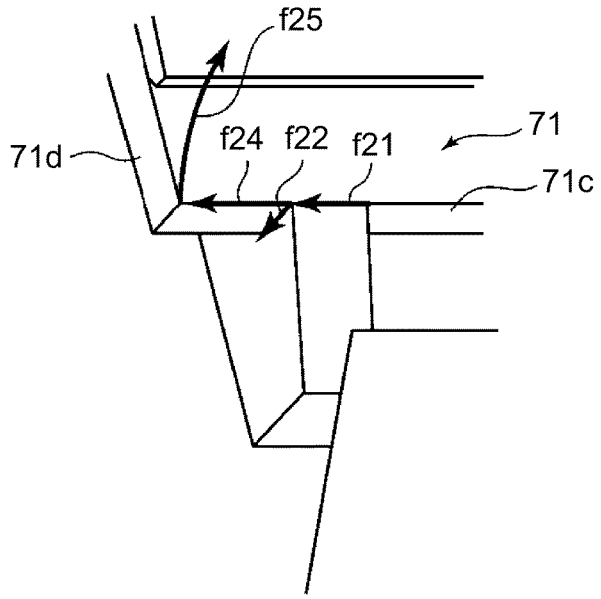
Figure 8:
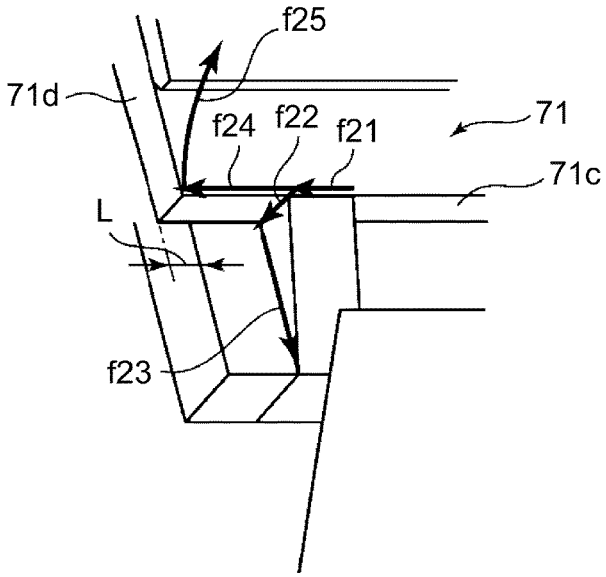

Parts (a) and (b) of FIG. 8 are schematic views showing the flow of the liquid developer in Comparison Example and Embodiment 2, respectively.

Figure 9:
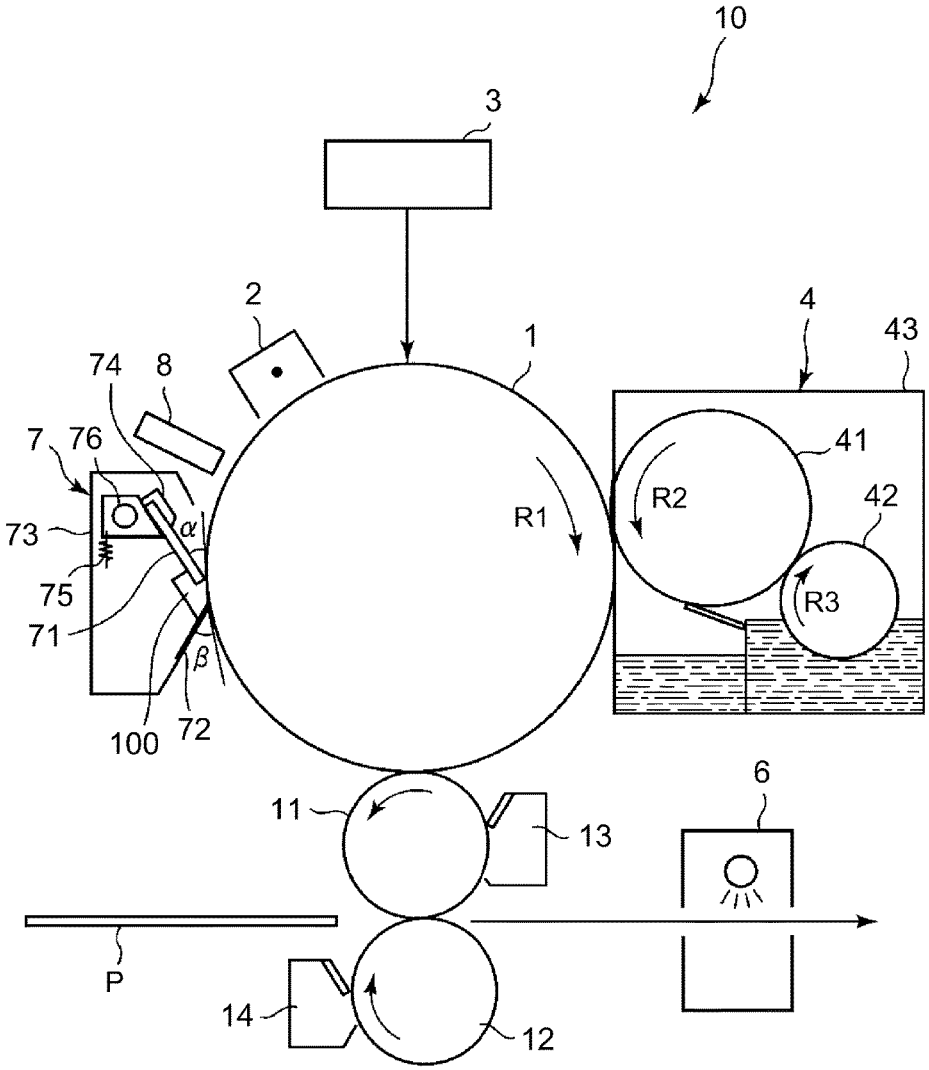

FIG. 9 is a schematic sectional view showing another embodiment of the image forming apparatus.

DESCRIPTION OF EMBODIMENTS

In the following, a cleaning device and an image forming apparatus according to the present invention will be specifically described with reference to the drawings.

[Embodiment 1]

1. General Structure and Operation of Image Forming Apparatus

Figure 1:
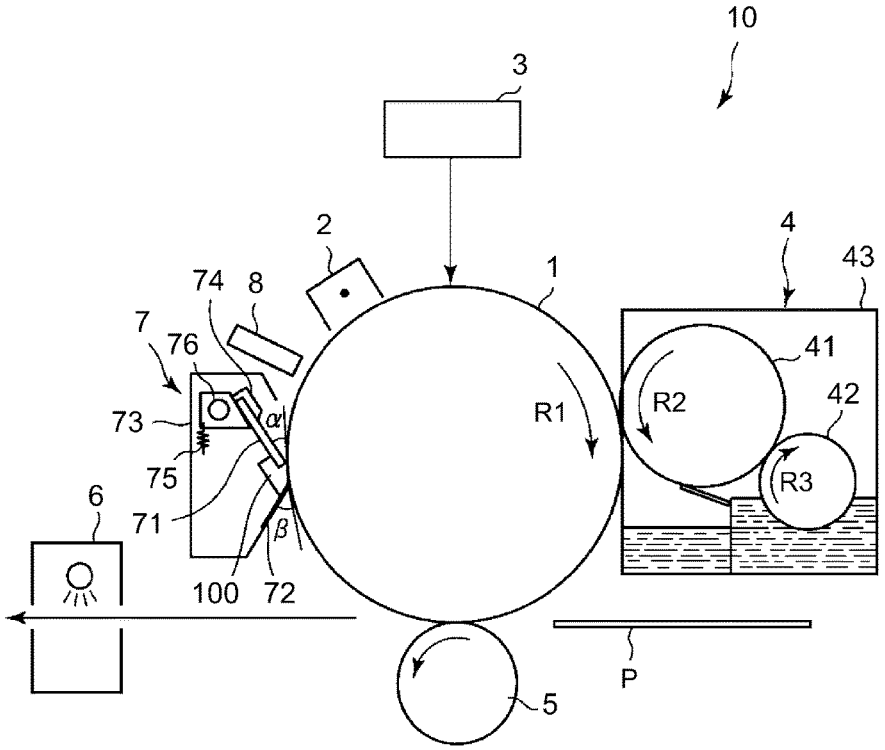
FIG. 1 is a schematic sectional view of an image forming apparatus.

FIG. 1 is a schematic sectional view of an image forming apparatus in this embodiment. An image forming apparatus 10 in this embodiment is a wet-type image forming apparatus of an electrophotographic type in which an image is formed using a liquid developer. Incidentally, as regards the image forming apparatus 10 and elements thereof, a front side of the drawing sheet of FIG. 1 is a "front" side, and a rear side of the drawing sheet of FIG. 1 is a "rear" side. A direction substantially perpendicular to the drawing sheet connecting the front side and the rear side of FIG. 1 is substantially parallel to a longitudinal direction (rotational axis direction) of a photosensitive drum 1 described below. Further, in FIG. 1, gravitation is exerted in a downward direction.

The image forming apparatus 10 includes the photosensitive drum 1 which is a rotatable drum-shaped (cylindrical) photosensitive member (electrophotographic photosensitive member) as an image bearing member. The photosensitive drum 1 is rotationally driven in an arrow R1 direction in the figure at a predetermined peripheral speed (process speed). In this embodiment, the peripheral speed of the photosensitive drum 1 during image formation is 800 mm/sec. Further, in this embodiment, the photosensitive drum 1 is an amorphous silicon drum of 84 mm in diameter and 380 mm in length with respect to the longitudinal direction (rotational axis direction). A surface of the rotating photosensitive drum 1 is electrically charged uniformly to a predetermined polarity and a predetermined potential by a charger 2 as a charging means. On the charged surface of the photosensitive drum 1 is subjected to scanning exposure by being irradiated with laser light depending on an image signal by an exposure device (laser optical system) 3 as an exposure means (latent image forming means), so that an electrostatic latent image (electrostatic image) is formed on the photosensitive drum 1. The electrostatic latent image formed on the photosensitive drum 1 is developed by a developing device 4 as a developing means, so that a toner image is formed on the photosensitive drum 1.

The developing device 4 includes a developing container 43 for accommodating a liquid developer (developer liquid) in which powdery toner as a dispersoid is dispersed in a carrier liquid (liquid carrier) as a dispersion medium. In the developing container 43, a developing roller 41 as a developer carrying member is provided rotatably. In this embodiment, the developing roller 41 is an electroconductive urethane rubber roller of 40 mm in diameter and 350 mm in length with respect to the longitudinal direction (rotational axis direction). Further, in the developing container 43, an application roller 42 for applying the liquid developer onto the developing roller 41 is provided rotatably. The developing roller 41 and the application roller 42 are rotationally driven in an arrow R2 direction and an arrow R3 direction, respectively, in the figure. The developing roller 41 is disposed opposed to the photosensitive drum 1, and feeds the liquid developer, applied by the application roller 42, to an opposing (developing portion) to the photosensitive drum 1. Incidentally, the toner image on the photosensitive drum 1 is formed by containing the toner and the carrier liquid existing at a periphery of the toner. During a developing step, to the developing roller 41, a predetermined developing bias is applied, so that movement of the liquid developer from the developing roller 41 to the photosensitive drum 1 is carried out using an electric field. Incidentally, to the developing device 4, the liquid developer is properly supplied by an unshown supplying device. The toner is constituted by incorporating a coloring material in a binder resin material. Further, as the carrier liquid, a carrier liquid of ultraviolet (UV)-curable layer or a heat-curable type or the like is used, but in this embodiment, a UV-curable carrier liquid was used. A toner content (a proportion of a weight of the toner to an entire weight of the liquid developer) of the liquid developer supplied to the developing device 4 is about 5-10%.

The toner image formed on the photosensitive drum 1 is transferred onto a transfer-receiving material P, nipped and fed by the photosensitive drum 1 and a transfer roller 5, in a transfer portion (transfer nip) N which is a contact portion between the photosensitive drum 1 and the transfer roller 5 as a transfer means. The transfer roller 5 is rotated by rotation of the photosensitive drum 1. During a transfer step, to the transfer roller 5, a predetermined transfer bias is applied, so that movement of the liquid developer from the photosensitive drum 1 onto the transfer-receiving material P is carried out using an electric field. The transfer-receiving material P is fed to the transfer portion N by an unshown feeding (conveying) device while being timed to the toner image on the photosensitive drum 1. In this embodiment, the transfer-receiving material P is coated paper of about 128 $g/m^2$ in basis weight, for example.

The transfer-receiving material P on which the toner image is transferred is conveyed to a fixing device 6 as a fixing means, and after the toner image is formed on the surface thereof by the fixing device 6, and is discharged to an outside of an apparatus main assembly of the image forming apparatus 10. In this embodiment, the fixing device 6 fixes the image on the transfer-receiving material P by irradiating the transfer-receiving material P, on which the toner and the carrier liquid are carried, with UV rays and thus the carrier liquid is cured, so that the image is fixed on the transfer-receiving material P.

On the other hand, the liquid developer (residual developer) which remains on the photosensitive drum 1 without being transferred onto the transfer-receiving material P during a transfer step and which contains the toner and the carrier liquid is removed and collected from the surface of the photosensitive drum 1 by a cleaning device 7 as a cleaning means. Further, the surface of the photosensitive drum 1 after being cleaned by the cleaning device 7 is irradiated with light by an electrically discharging lamp 8 as an electrically discharging means.

2. Cleaning Device

Next, a constitution of the cleaning device 7 will be described. In this embodiment, the cleaning device 7 includes a blade (cleaning blade) 71, a receptor sheet 72 and a collecting container 73.

The blade 71 is a cleaning member for scraping off the liquid developer from the surface of the photosensitive drum 1 in contact with the surface of the photosensitive drum 1 as a rotatable member for carrying the liquid developer. The blade 71 is fixed to a fixing metal plate 74 as a fixing member swingable (rotatable) by a swingable shaft 76 mounted to the collecting container 73. The blade 71 is pressed against and held by the surface of the photosensitive drum 1 with a predetermined pressure by rotating the fixing metal plate 74 by a pressing (urging) spring 75 as an urging means. The blade 71 is a member which has a predetermined length with respect to a longitudinal direction, substantially parallel to the longitudinal direction (rotational axis direction) of the photosensitive drum 1, and a short-side direction substantially perpendicular to the longitudinal direction thereof and which is formed of an elastic material in a plate shape (blade shape). In this embodiment, the blade 71 is formed with a plate-shaped polyurethane rubber of 80 degrees in JIS-A rubber hardness, 2-3 mm in thickness, 20 mm in length with respect to the short-side direction and 376 mm in length with respect to the longitudinal direction. The blade 71 is contacted to the surface of the photosensitive drum 1 at an edge portion 71*e* (part (a) of FIG. 2) of a free end portion which is one of end portions thereof with respect to the short-side direction in a state in which the free end portion is oriented in a counterdirection to the rotational direction of the photosensitive drum 1, i.e., oriented toward an upstream side of the rotational direction of the photosensitive drum 1. In this embodiment, the blade 71 is fixed to the fixing metal plate 74 in a range of 10 mm at a fixing end portion which is the other end portion with respect to the short-side direction. Further, in this embodiment, in a cross-section shown in FIG. 1, an angle $\alpha$ formed by a surface 71*a* (part (a) of FIG. 2) of the blade 71 with respect to a tangential line of the photosensitive drum 1 at a contact portion between the blade 71 and the photosensitive drum 1 is set at 25°. In this embodiment, the blade 71 is disposed so that a free end portion side which is one end portion side with respect to the short-side direction is a lower side with respect to the direction of gravitation and so that a fixing end portion side which is the other end portion side is an upper side with respect to the direction of gravitation.

The receptor sheet 72 is a sheet which provided along the longitudinal direction of the blade 71 on a side upstream of the blade 71 with respect to the rotational direction of the photosensitive drum 1 and which collects the liquid developer, in the collecting container 73, scraped off from the surface of the photosensitive drum 1 by the blade 71. The receptor sheet 72 is mounted to the collecting container 73. The receptor sheet 72 is a flexible member which has a predetermined length with respect to a longitudinal direction, substantially parallel to the longitudinal direction (rotational axis direction) of the photosensitive drum 1, and a short-side direction substantially perpendicular to the longitudinal direction thereof and which is formed of a flexible material in a sheet shape (film shape). The thickness of the receptor sheet 72 may suitably be about 25 μm-125 μm. In this embodiment, the receptor sheet 72 is formed with a sheet-PET (polyethylene terephthalate) resin material of 50 μm in thickness, 12 mm in length with respect to the short-side direction and 362 mm in length with respect to the longitudinal direction. The receptor sheet 72 is contacted to the surface of the photosensitive drum 1 at a free end portion which is one of end portions thereof with respect to the short-side direction in a state in which the free end portion is oriented toward a downstream side of the rotational direction of the photosensitive drum 1. In this embodiment, the receptor sheet 72 is fixed to the collecting container 73 in a range of 2 mm at a fixing end portion which is the other end portion with respect to the short-side direction. Further, in this embodiment, a contact portion between the receptor sheet 72 and the photosensitive drum 1 is provided at a position of 5 mm from the contact portion between the blade 71 and the photosensitive drum 1 on an upstream side with respect to the rotational direction of the photosensitive drum 1. Further, in this embodiment, in a cross-section shown in FIG. 1, an angle $\beta$ formed by a surface 72*a* (part (a) of FIG. 2) of the receptor sheet 72 with respect to a tangential line of the photosensitive drum 1 at a contact portion between the receptor sheet 72 and the photosensitive drum 1 is set at 30°.

In this embodiment, the photosensitive drum 1, the blade 71 and the receptor sheet 72 are disposed on the basis of a center with respect to associated one of the longitudinal directions thereof, and a member having a relatively shorter longitudinal length is disposed inside a member having a relatively longer longitudinal length.

The collecting container 73 is a container for accommodating the liquid developer scraped off from the photosensitive drum 1 by the blade 71. A bottom surface of the collecting container in an inclined surface such that the bottom lowers from a front side toward a rear side, and the liquid developer flows by gravitation, so that the liquid developer is moved toward a collected developer container (not shown).

Further, the cleaning device 7 includes a seal member 100 for preventing movement of the liquid developer which flows toward one end surface side of the blade 71 with respect to the longitudinal direction of the blade 71 along the longitudinal direction of the blade 71 after passing through a small gap at the contact portion between the blade 71 and the photosensitive drum 1. In this embodiment, the seal member 100 is provided in the neighborhood of each of longitudinal end portions of the blade 71.

3. Structure of Seal Member

Part (a) of FIG. 2 is a perspective view of the seal member 100 in this embodiment (in which also the blade 71, the fixing metal plate 74 and the receptor sheet 72 are indicated by broken lines). The seal members 100 provided on both longitudinal end portion sides of the blade 71 have a symmetrical structure with respect to a longitudinal center of the blade 71, and therefore, description thereof will be made by paying attention to the seal member 100 on one end portion side (front end portion side).

The seal member 100 is disposed so as to be spaced from a longitudinal end surface (side end surface) 71*d* of the blade 71 toward a longitudinal central portion of the blade 71. The seal member 100 is constituted so as to be adjacent to an end surface (free end surface) 71*c* of the blade 71 on a free end portion side with respect to the short-side direction of the blade 71 and so as to prevent movement of the liquid developer which passes through the contact portion between the blade 71 and the photosensitive drum 1 and which flows toward the side end surface 71*d* side of the blade 71. The seal member 100 is constituted so that an interior corner line (concave edge) 104 for guiding the liquid developer, into the collecting container 73, which passes through an adjacent portion between the free end surface 71*c* of the blade 71 and the seal member 100 and which flows towards the side end surface 71*d* side of the blade 71 is formed. That is, this interior corner line 104 constitutes a path in which the liquid developer likely to move toward an outside of the side end surface 71*d* of the blade 71 along the free end surface 71*c* of the liquid developer is guided by gravitation and surface tension and is collected in the collecting container 73. This constitution will be specifically described.

In this embodiment, the seal member 100 is constituted by including a shielding portion 101 as a first portion and a support portion 102 as a second portion, which are constituted by individual members. Incidentally, as regards the seal member 100, the short-side direction of the blade 71 is a "height" direction, the longitudinal direction of the blade 71 is a "widthwise" direction, and a thickness direction of the blade 71 is a "depth" direction. With respect to the depth direction, the photosensitive drum 1 side is a "front" side, and a side opposite from the photosensitive drum 1 side is a "rear" side. Part (b) of FIG. 2 includes a rear view, a front-side side view and a top (plan) view of the shielding portion 101, and part (b) of FIG. 2 includes a rear view, a front-side side view and a top (plan) view of the support portion 102. In this embodiment, in parts (a) and (b) of FIG. 2, an upper portion and a lower portion are those with respect to the direction of gravitation.

The shielding portion 101 includes a main portion 117 having a substantially rectangular prism shape such that the shielding portion 101 has a predetermined length with respect to each of the height direction, the widthwise direction and the depth direction and includes a projected portion 118 which is constituted integrally with the main portion 117 and which projects toward the front side with respect to the depth direction. The projected portion 118 is formed so that a projection amount thereof with respect to the depth direction is maximum in the neighborhood of a center of the main portion 117 with respect to the height direction and so that the depth thereof becomes zero at a lower-side end portion and the projected portion 118 is connected with the main portion 117 at the lower-side end portion. A surface, of the projected portion 118, which forms a stepped portion between the projected portion 118 and the main portion 117 and which is substantially parallel to the depth direction depth direction of the projected portion 118 constitutes a blade adjacent surface 111 as a first surface adjacent to the free end surface 71*c* of the blade 71. Further, a front-side surface (inclined surface) of the projected portion 118 constitutes a drum adjacent surface 112 as a second surface adjacent to the surface (peripheral surface) of the photosensitive drum 1. Further, a surface, of the projected portion 118, which is connected with the blade adjacent surface 111 and the drum adjacent surface 112 and which is oriented toward the side end surface 71*d* of the blade 71 with respect to the longitudinal direction of the blade 71 constitutes a path-forming surface 113 as a third surface. In this embodiment, a height H1 of the main portion 117 is 14 mm, and a height H2 of the projected portion 118 is 6 mm. Further, in this embodiment, a width W1 of the shielding portion 101 (the main portion 117, the projected portion 118) is 4 mm, a depth D1 of the main portion 117 is 5 mm, and a depth D2 at a portion (the blade adjacent surface 111) where a projection amount of the projected portion 118 is maximum is 3 mm. This depth D2 of the projected portion 118 may preferably be large to the extent that the depth D2 is equal to the thickness of the blade 71 or larger by about 1 mm - 3 mm than the thickness of the blade 71.

The support portion 102 has a rectangular prism shape substantially the same as that of the main portion 117 of the shielding portion 101. The support portion 102 includes a drum opposing surface 121, as a fourth surface, which is spaced from the surface of the photosensitive drum 1 than the drum adjacent surface 112 of the shielding portion 101 is so as not to contact the surface (peripheral surface) of the photosensitive drum 1 and which faces the surface side of the photosensitive drum 1. The support portion 102 is disposed on the side end surface 71*d* side of the blade 71 with respect to the longitudinal direction than the shielding portion 101 is. In this embodiment, the support portion 102 is 14 mm in height H3, 4 mm in width W2, and 5 mm in depth D3.

The seal member 100 is mounted to the collecting container 73 by disposing a front-side surface 116 of the main portion 117 of the shielding portion 101 with respect to the widthwise direction and a rear-side side surface 122 of the support portion 102 so as to be adjacent to each other. Further, the free end surface 71*c* is caused to be adjacent to the blade adjacent surface 111 of the shielding portion 101, and the blade 71 is disposed so that the free end surface 71*c* is engaged with a stepped portion between the main portion 117 and the projected portion 118. As a result, a first interior corner line (concave edge) 103 is formed at an adjacent portion between the path-forming surface 113 of the shielding portion 111 and the free end surface 71*c* of the blade 71. Further, the second interior corner line 104 is formed at an adjacent portion between the path-forming surface 113 of the shielding portion 101 and the drum opposing surface 121 of the support portion 102. The seal member 100 may preferably be disposed so as to be spaced from the side end surface 71*d* toward a central portion by a sufficient predetermined distance or more with respect to the longitudinal direction of the blade 71. In this embodiment, the seal member 100 is disposed so as to be spaced by a distance L=4 mm from the side end surface 71*d* toward the central portion with respect to the longitudinal direction of the blade 71. This distance L will be described later. In this embodiment, a back surface 71*b* of the blade 71 is contacted to a photosensitive drum 1—side surface 115 of the main portion 117 of the shielding portion 101 and to a photosensitive drum 1—side surface 123 of the support portion 102. These surfaces of the seal member 100 may also be fixed to the back surface 71*b* of the blade 71 by an arbitrary fixing means such as an adhesive.

In this embodiment, the blade adjacent surface 111 of the shielding portion 101 and the free end surface 71*c* of the blade 71 are contacted (hermetically contacted) to each other, but may also be caused to be close to (be opposed to) each other with a small gap therebetween in a predetermined amount or less. When the gap is 1.0 mm or less, the seal member 100 sufficiently prevents leakage of the liquid developer to an outside of the blade 71 with respect to the longitudinal direction and thus sufficiently functions as the seal member 100, but may preferably be 0.5 mm or less, further preferably be 0.25 mm or less. That is, the blade adjacent surface 111 of the shielding portion 101 may only be required to be disposed adjacent to the free end surface 71*c* of the blade 71 in a range of 0-1.0 mm on an upstream side of the rotational direction of the photosensitive drum 1.

In this embodiment, the drum adjacent surface 112 of the shielding portion 101 is contacted (hermetically contacted) to the surface of the photosensitive drum 1, but may also be caused to be close to (be opposed to) each other with a small gap therebetween in a predetermined amount or less. When the gap is 1.0 mm or less, the seal member 100 sufficiently prevents leakage of the liquid developer to an outside of the blade 71 with respect to the longitudinal direction and thus sufficiently functions as the seal member 100, but may preferably be 0.5 mm or less, further preferably be 0.25 mm or less. That is, the drum adjacent surface 112 of the shielding portion 101 may only be required to be disposed adjacent to the surface of the photosensitive drum 1 in a range of 0-1.0 mm.

In this embodiment, the support portion 102 is contacted (hermetically contacted) to the shielding portion 101, but may also be caused to be close to (be opposed to) each other with a small gap therebetween in a predetermined amount or less. When the gap is 1.0 mm or less, the seal member 100 sufficiently prevents leakage of the liquid developer to an outside of the blade 71 with respect to the longitudinal direction and thus sufficiently functions as the seal member 100, but may preferably be 0.5 mm or less, further preferably be 0.25 mm or less. That is, the support portion 102 may only be required to be disposed adjacent to the shielding portion 101 in a range of 0-1.0 mm on the side end surface side of the blade 71 with respect to the longitudinal direction.

The shielding portion 101 and the support portion 102 have a proper elastic force and are excellent in sealing property, and therefore may preferably be formed with a sponge (elastic foam member). In this embodiment, as a material of this sponge, from the viewpoints of a resistance to the liquid developer and abrasion, a fluorine-containing sponge was used. The fluorine-containing sponge may also be selected from the group consisting of a fluorine-containing rubber foam member and a foam member coated with a fluorine-containing resin material (such as a foam member, e.g., urethane foam or the like, which is immersed in a fluorine-containing resin-containing solvent and which is then dried). The seal member 100 may also be a sponge formed by another material when the material at least has the resistance to the liquid developer. Here, the resistance to the liquid developer refers to the material having a sufficient resistance to dissolution in the liquid developer or to a remarkable lowering in mechanical characteristic. Further, the seal member 100 can also be formed of a synthetic resin, rubber or elastomer, as desired, when the material can sufficiently achieve an action described below. In the case where the shielding portion 101 and the support portion 102 are constituted by individual members, these portions may also be fixed to each other by an arbitrary fixing means such as (adhesive) bonding, welding or the like.

The receptor sheet 72 is provided so as to contact at least a part of the shielding portion 101 of the seal member 100 as shown in (a) of FIG. 2. In this embodiment, a lower-side part of the drum adjacent surface 112 in a range of 2 mm on the rear side with respect to the widthwise direction of the shielding portion 101 contacts the back surface 72*b* of the receptor sheet 72. The receptor sheet 72 may also be disposed so as to contact both the shielding portion 101 and the support portion 102 of the seal member 100.

4. Action of Seal Member

Next, the action of the seal member 100 will be described. The cleaning device 7 scrapes off the liquid developer, by the cleaning blade 71, from the surface of the photosensitive drum 1 rotating in an arrow R1 direction shown in FIG. 1. At a portion other than the longitudinal shielding portions of the blade 71, the liquid developer blocked by the blade 71 stagnates on a side upstream of the edge 71*e* of the blade 71 with respect to the rotational direction of the photosensitive drum 1, and thereafter moves along the receptor sheet 72 by gravitation and then is collected in the collecting container 73. On the other hand, the liquid developer at the longitudinal end portion (particularly in a range of about 20 mm from the side end surface 71*d* toward the central portion) changes in behavior depending on the constitution of the seal member 100.

FIG. 3 is a schematic view in which a flow of the liquid developer in this embodiment is viewed from the surface 71*a* side of the blade 71. Most of the liquid developer moving toward the side end surface 71*d* side between the blade 71 and the photosensitive drum 1 is, as shown by an arrow f11 in FIG. 3, blocked by the side surface 119 of the main portion 117 and the side surface 114 of the projected portion of the shielding portion 101 (parts (a) and (b) of FIG. 2). This liquid developer moves along a wall surface of the shielding portion 101 and is collected in the collecting container 73 through the receptor sheet 72. A part of the liquid developer moves toward the side end surface 71*d* side of the blade 71 through between the free end surface 71*c* of the blade 71 and the blade adjacent surface 111 (parts (a) and (b) of FIG. 2) of the shielding portion 101 by surface tension. This liquid developer moves, as shown by an arrow f12 in FIG. 3, along a interior corner line formed by the shielding portion 101 and the support portion 102 by gravitation and surface tension, and is collected in the collecting container 73 through the receptor sheet 72. FIG. 4 is a perspective view further specifically showing the flow of the liquid developer in this embodiment. As shown in FIG. 4, a part of the liquid developer flows through between the free end surface 71*c* of the blade 71 and the blade adjacent surface 111 of the shielding portion 101 as shown by an arrow f21. The liquid developer then flows along the first interior corner line 103 by surface tension as shown by an arrow f22 or passes through between the free end surface 71*c* of the blade 71 and the blade adjacent surface 111 of the shielding portion 101 and thus directly reaches the second interior corner line 104. The liquid developer flows along the second interior corner line 104 by gravitation and surface tension as shown by an arrow f23 and then is collected in the collecting container 73. For that reason, it is possible to prevent the liquid developer to reach the side end surface 71*d* of the blade 71 as shown by a broken line arrow f24.

Here, for example, it is considered that a constitution for preventing generation of the liquid ring by catching the liquid developer through provision of a groove at each of both end portions of the blade 71 is employed, for example. However, in such a constitution, the groove is clogged by drying the liquid developer, and in the case where a catching function does not act on the liquid developer, the liquid developer generates. As regards the interior corner lines in this embodiment, even when the liquid developer is dried, a path along which the liquid developer flows is not clogged, and therefore, such a problem does not occur.

[Embodiment 2]

In Embodiment 2, the seal member 100 having the same constitution as that in Embodiment 1 was provided at a position with a distance L=1 mm from the side end surface 71*d* toward the central portion with respect to the longitudinal direction of the blade 71.

Next, a result of verification of an effect of the seal members in Embodiments 1 and 2 and in Comparison Examples 1 to 3 described later will be described. In a verification test, the liquid developer of about 1 μm in thickness on the photosensitive drum 1 rotating at the peripheral speed during the image formation was supplied to the blade 71 for about 10 minutes and longitudinal end portions of the blade 71 and a corresponding surface of the photosensitive drum 1 were observed with eyes, and thus generation or non-generation of the liquid ring and the re-application of the liquid developer were checked.

Part (a) of FIG. 5 is a perspective view of a seal member 200 used in Comparison Examples 1 and 2 (in which the blade 71, the fixing metal plate 74 and the receptor sheet 72 are indicated by broken lines). The seal member 200 has surfaces adjacent to the side end surface 71*c* and the free end surface 71*c*, respectively, of the blade 71. In Comparison Example 1, in order to use the seal member 200 in the dry-type image forming apparatus of the electrophotographic type, the seal member 200 was provided with a gap (about 1.0 mm) between itself and each of the side end surface 71*d* and the free end surface 71*c* of the blade 71. On the other hand, in Comparison Example 2, the seal member 200 was provided in contact (hermetic contact) with each of the side end surface 71*d* and the free end surface 71*c* with predetermined pressure.

Part (b) of FIG. 5 is a perspective view of a seal member 300 used in Comparison Example 3 (in which the blade 71, the fixing metal plate 74 and the receptor sheet 72 are indicated by broken lines). This seal member 300 corresponds to a seal member constituted only by the shielding portion 10) of the seal member 100 in Embodiment 1. In Comparison Example 3, the seal member 300 was provided at a position with a distance L=4 mm from the side end surface 71*d* toward the central portion with respect to the longitudinal direction of the blade 71.

The materials constituting the seal members in Embodiments 1 and 2 and in Comparison Examples 1 to 3 were the same. The image forming apparatuses Embodiments 1 and 2 and in Comparison Examples 1 to 3 had substantially the same constitution except that seal constitutions by the seal members were different from each other. Verification results Embodiments 1 and 2 and in Comparison Examples 1 to 3 are shown in Table 1.

TABLE 1

| | EMB. 1 | EMB. 2 | CE1*1 | CE2*2 | CE3*3 |
|---|---|---|---|---|---|
| RA*4 | ○ | ○ | x | x | ○ |
| LR*5 | ○ | Δ | x | x | x |

*1"CE1" is Comparison Example 1.
*2"CE2" is Comparison Example 2.
*3"CE3" is Comparison Example 3.
*4"RA" is the re-application.
*5"LR" is the liquid ring.

In Embodiment 1, the liquid developer was collected in the collecting container 73 along the path as described above, so that the liquid ring and the re-application of the liquid developer did not occur.

In Embodiment 2, the re-application did not occur, but the liquid ring generated some extent although a degree thereof is slight. This would be considered because in Embodiment 1, the distance L from the support portion 102 to the side end portion 71*d* of the blade 71 is 4 mm, whereas in Embodiment 2, the distance L is 1 mm. Part (b) of FIG. 7 is a schematic view of a flow of the liquid developer in Embodiment 2 as seen from the surface 71*a* side of the blade 71. Part (b) of FIG. 8 is a perspective view specifically showing the flow of the liquid developer in Embodiment 2. In Embodiment 2, similarly as in Embodiment 1 (FIGS. 3 and 4), as shown by an arrow f12 in part (b) of FIG. 7 and arrows f22 and f23 in part (b) of FIG. 8, a path along which the liquid developer passes and is collected in the collecting container 73 is formed. However, the liquid developer has a property such that the liquid developer is liable to be deposited by surface tension on wall surfaces of the blade 71, the photosensitive drum 1, the seal member 100, the receptor sheet 72 and the like, and on the other hand, does not readily move until the liquid developer gathers in some amount. For that reason, in Embodiment 2, the distance L is short and a space of liquid accumulation formed between the side end surface 71*d* of the blade 71 and the seal member 100 is small, so that the liquid developer does not readily flow through the interior corner line toward the collecting container 73 in some instances. As a result, as shown by an arrow f13 in part (b) of FIG. 7 and arrows f24 and f25 of part (b) of FIG. 8, the liquid developer leaks to an outside of the side end portion 71*d* of the blade 71, so that the liquid ring generates in some instances. As a result of study by the present inventors, when the distance L from the side end surface 71*d* of the blade 71 to the support portion 102 is 3 mm or more as in Embodiment 1, it was confirmed that the liquid ring did not generate. In general, the distance L is sufficient when the distance L is about 10 mm or less.

In Comparison Examples 1 and 2, the liquid ring and the re-application of the liquid developer occurred. Parts (a) and (b) of FIG. 6 are schematic views showing flows of the liquid developers in Comparison Examples 1 and 2, respectively, as seen from the surface 71*a* side of the blade 71. As regards the flows of the liquid developers in the comparison examples, arrows showing the same flows as those (FIGS. 3 and 4) in Embodiment 1 are represented by the same reference symbols (the same applies hereinafter). However, when the constitution of Comparison Example 1 is used in the dry-type image formation, as shown by an arrow f13 in part (a) of FIG. 6, the liquid developer passes through the gap between the seal member 200 and the blade 71 and thus leaks out, so that the liquid ring generates. Further, after the seal member 200 is wetted with the liquid developer, the liquid ring generates. In Comparison Example 2, the seal member 200 is contacted to the blade 71 with the predetermined pressure, but in general, a small gap also generates at the contact portion in actuality. For that reason, also in the constitution of Comparison Example 2, in the dry-type image formation, the seal member 200 does not properly function, and as shown by an arrow f13 in part (b) of FIG. 6, the liquid developer passes through the gap between the seal member 200 and the blade 71 by surface tension and thus leaks out, so that the liquid ring generates. Further, after the seal member 200 is wetted with the liquid developer, the liquid ring generates. In the constitution of Comparison Example 2, pressure of the seal member 200 applied to the blade 71 has the influence on a contact pressure distribution of the blade 71 to the photosensitive drum 1 with respect to the longitudinal direction of the blade 71, and therefore, there is a liability that cleaning itself by the blade 71 becomes unstable.

In Comparison Example 3, the re-application did not generate, but the liquid ring generated. Part (a) of FIG. 7 is a schematic view of a flow of the liquid developer in Comparison Example 3 as seen from the surface 71*a* side of the blade 71. Part (a) of FIG. 8 is a perspective view specifically showing the flow of the liquid developer in Comparison Example 3. In Comparison Example 3, of the developer moved toward the side end portion 71*d* of the blade 71 through the adjacent portion between the blade 71 and the seal member 300 by the surface tension, an amount of the developer collected in the collecting container 73. This would be considered because although the liquid developer flows along the interior corner line formed by the blade and the seal member 300 (arrow f22 in part (a) of FIG. 8), the interior corner line is closed, and therefore, is saturated soon with the liquid developer. For that reason, as shown by an arrow f13 in part (a) of FIG. 7 and arrows f24 and f25 of part (a) of FIG. 8, the liquid developer leaks to an outside of the side end portion 71*d* of the blade 71, so that the liquid ring generates.

As described above, according to this embodiment, the liquid developer flowing toward the outside of the seal member 100 can be efficiently collected in the collecting container 73. For that reason, it is possible to suppress generation of the problems such as the liquid ring and the re-application of the liquid developer.

[Other Embodiments]

In the above, the present invention was described based on the specific embodiments, but the present invention is not limited to the above-described embodiments.

In the above-described embodiments, an object to be cleaned by the cleaning device was the photosensitive drum, but the present invention is not limited thereto. For example, in the image forming apparatus 10 in the above-described embodiments, a cleaning device for removing and cleaning the liquid developer deposited on the transfer roller 5 as a rotatable member is provided in some cases. FIG. 9 is a schematic sectional view of another example of the wet-type image forming apparatus of the electrophotographic type. In FIG. 9, elements having functions or constitutions identical or corresponding to those of the image forming apparatus of FIG. 1 are represented by the same reference numerals or symbols. In the image forming apparatus of FIG. 9, the toner image formed on the photosensitive drum 1 is, after being primary-transferred onto an intermediary transfer roller 11 as the intermediary transfer member, secondary-transferred onto the transfer(-receiving) material P by the action of a secondary transfer roller 12 as the secondary transfer means. In such an image forming apparatus 10, a cleaning device 13 for removing and collecting the liquid developer remaining on the intermediary transfer roller 11 as the rotatable member is provided in some cases. Further, a cleaning device 14 for removing and collecting the liquid developer deposited on the secondary transfer roller 12 as the rotatable member is provided in some cases. The present invention is similarly applied to these (other) cleaning devices, so that effects similar to those in the above-described embodiments can be obtained. That is, when the cleaning devices include a blade for scraping off the liquid developer from the surface of the rotatable member in contact with the surface of the rotatable member carrying the liquid developer thereon, the present invention is applicable to the cleaning devices.

Further, the object to be cleaned by the cleaning device is not limited to the drum and rollers, but may also be a rotatable endless belt stretched by a plurality of stretching rollers.

In the above-described embodiments, the seal member includes the first portion (shielding portion) and the second portion (support portion) which are constituted by individual members, but the first portion and the second portion may also be constituted integrally with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-014510 filed on Jan. 30, 2017, which is hereby incorporated by reference herein in its entirety.

What is claimed is:

1. A cleaning device, capable of being provided at a predetermined position adjacent to an image bearing member carrying a liquid developer, for cleaning a surface of the image bearing member, said cleaning device comprising:

a blade configured to scrape the liquid developer off the surface of the image bearing member with movement of the image bearing member when said cleaning device is in the predetermined position, wherein said blade has a free end on one side and is supported on the other side by a supporting portion, and when said cleaning device is in the predetermined position, said blade satisfies the following i) to iv):

i) a front surface which is one of widthwise-height surfaces opposes the image bearing member, ii) an edge portion, formed at a crossing portion of the front surface and a free end surface which is a widthwise-thickness surface on a free end side, contacts the image bearing member at a contact portion, iii) the free end surface faces an upstream side of a movement direction of the image bearing member at the contact portion, and iv) said supporting portion is positioned above the free end surface with respect to a vertical direction, an accommodating portion configured to accommodate the liquid developer scraped off by said blade; and a pair of seal members provided adjacent to the free end surface in a position which is spaced from each of end portions of said edge portion toward a central portion of said edge portion and which corresponds to a neighborhood of each of the end portions, wherein said seal member positioned on one end side of an image portion with respect to a widthwise direction of said blade includes a first portion and a second portion adjacent to said first portion on the one end side, said first portion including a first surface, a second surface and a third surface, and said second portion including a fourth surface, wherein the first surface is provided opposed to and adjacent to the free end surface when said cleaning device is in the predetermined position, wherein the second surface is connected with the first surface in a neighborhood of said edge portion and is provided opposed to and adjacent to the surface of the image bearing member when said cleaning device is in the predetermined position, wherein the third surface is connected with the first surface and the second surface on the one end side and is provided so as to be substantially perpendicular to the free end surface and front surface and so as to face the one end side, wherein the fourth surface crosses substantially perpendicularly to the third surface and to the free end surface at a position adjacent to the third surface in the one end side and is opposed to the surface of the image bearing member in a position spaced more from the surface of the image bearing member than the second surface is when said cleaning device is in the predetermined position, wherein a first interior corner line is formed by the free end surface and the third surface so as to be substantially parallel to a thickness direction of said blade, and wherein a second interior corner line is formed by the third surface and the fourth surface so as to be connected with said first interior corner line and be substantially parallel to a height direction of said blade.

2. A cleaning device according to claim 1, wherein each of said first portion and said second portion is constituted by an individual member.

3. A cleaning device according to claim 1, wherein said first portion and said second portion contact each other at the adjacent portion or are close to each other with a gap of 1.0 mm or less at the adjacent portion.

4. A cleaning device according to claim 1, wherein said first portion and said second portion are integrally constituted with each other.

5. A cleaning device according to claim 1, wherein the first surface and the free end surface contact each other at the adjacent portion or are close to each other with a gap of 1.0 mm or less at the adjacent portion.

6. A cleaning device according to claim 1, wherein the second surface and the surface of the image bearing member contact each other at the adjacent portion or are close to each other with a gap of 1.0 mm or less at the adjacent portion.

7. A cleaning device according to claim 1, further comprising a sheet configured to guide the liquid developer, scraped off from the surface of the image bearing member by said blade, to said accommodating portion along a surface thereof, wherein a liquid developer of said sheet extends along the widthwise direction of said blade, and one end portion of said sheet with respect to a widthwise direction thereof is contacted to the surface of the image bearing member at a position upstream of said edge portion with respect to the movement direction of the image bearing member.

8. A cleaning device according to claim 7, wherein said sheet contacts at least a part of one of said seal members.

9. A cleaning device according to claim 1, wherein each of said seal members is formed with a sponge.

10. A cleaning device according to claim 9, wherein the sponge is a fluorine-containing sponge selected from the group consisting of a fluorine-containing rubber foam member and a foam member coated with a fluorine-containing resin material.

11. A cleaning device according to claim 1, wherein with respect to the widthwise direction, a minimum distance from each of height-thickness surfaces of said blade to a corresponding second portion with respect to the widthwise direction of said blade is 3 mm or more.

12. A cleaning device according to claim 1, wherein a distance between the second interior corner line and an exterior corner line formed at a crossing portion of the second surface and the third surface with respect to the thickness direction decreases to zero with an increasing distance, with respect to the height direction, from the free end surface of said blade.

13. An image forming apparatus comprising:

a movable image bearing member configured to carry a liquid developer;

a blade configured to scrape the liquid developer off the surface of the image bearing member with movement of the image bearing member, wherein said blade has a free end on one side and is supported on the other side by a supporting portion, and said blade satisfies the following i) to iv):

i) a front surface which is one of widthwise height surfaces opposes the image bearing member, ii) an edge portion, formed at a crossing portion of the front surface and a free end surface which is a widthwise thickness surface on a free end side, contacts the image bearing member at a contact portion, iii) the free end surface faces an upstream side of a movement direction of the image bearing member at the contact portion, and iv) said supporting portion is positioned above the free end surface with respect to a vertical direction, an accommodating portion configured to accommodate the liquid developer scraped off by said blade; and a pair of seal members provided adjacent to the free end surface in a position which is spaced from each of end portions of said edge portion toward a central portion of said edge portion and which corresponds to a neighborhood of each of the end portions, wherein said seal member positioned on one end side of said image portion with respect to a widthwise direction of said blade includes a first portion and a second portion adjacent to said first portion on the one end side, said first portion including a first surface, a second surface and a third surface, and said second portion including a fourth surface, wherein the first surface is provided opposed to and adjacent to the free end surface, wherein the second surface is connected with the first surface in a neighborhood of said edge portion and is provided opposed to and adjacent to the surface of the image bearing member, wherein the third surface is connected with the first surface and the second surface on the one end side and is provided so as to be substantially perpendicular to the free end surface and front surface and so as to face the one end side, wherein the fourth surface crosses substantially perpendicularly to the third surface and to the free end surface at a position adjacent to the third surface in the one end side and is opposed to the surface of the image bearing member in a position spaced more from the surface of the image bearing member than the second surface is, wherein a first interior corner line is formed by the free end surface and the third surface so as to be substantially parallel to a thickness direction of said blade, and wherein a second interior corner line is formed by the third surface and the fourth surface so as to be connected with said first interior corner line and be substantially parallel to a height direction of said blade.

* * * * *